US006835333B2

(12) United States Patent
Danielson et al.

(10) Patent No.: US 6,835,333 B2
(45) Date of Patent: Dec. 28, 2004

(54) COMBINATIONS FOR USE AS TONERS IN POLYESTERS

(75) Inventors: Todd E. Danielson, Moore, SC (US); Jason Sprinkle, Woodruff, SC (US); Daniel Connor, Inman, SC (US); Donnie Hyder, Boiling Springs, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/140,229

(22) Filed: May 7, 2002

(65) Prior Publication Data

US 2003/0209698 A1 Nov. 13, 2003

(51) Int. Cl.[7] ..... G02B 5/22; C08J 5/00; C09B 1/02

(52) U.S. Cl. ..... 252/589; 8/648; 524/242; 524/357; 264/1.24; 264/1.32; 442/131

(58) Field of Search ..... 8/648; 252/589; 264/1.32, 1.24; 524/242, 357; 442/131

(56) References Cited

U.S. PATENT DOCUMENTS

| | | | | |
|---|---|---|---|---|
| 3,546,270 A | | 12/1970 | Rudolf et al. | |
| 3,634,320 A | | 1/1972 | Wolfang et al. | |
| 3,809,707 A | | 5/1974 | Reginoldus et al. | |
| 3,880,992 A | | 4/1975 | Smolin et al. | 424/60 |
| 4,129,412 A | * | 12/1978 | Günther et al. | 8/648 |
| 4,284,729 A | | 8/1981 | Cross et al. | 521/158 |
| 4,359,570 A | | 11/1982 | Davis et al. | 528/289 |
| 4,496,757 A | | 1/1985 | Dexter et al. | 560/82 |
| 4,617,374 A | | 10/1986 | Pruett et al. | 528/288 |
| 4,619,990 A | | 10/1986 | Elmasry | 534/573 |
| 4,732,570 A | | 3/1988 | Baumgartner et al. | 8/506 |
| 4,745,174 A | * | 5/1988 | Pruett et al. | 528/289 |
| 4,830,763 A | * | 5/1989 | Hefti et al. | 8/648 X |
| 4,845,188 A | | 7/1989 | Weaver et al. | 528/272 |
| 4,920,169 A | | 4/1990 | Avar | 524/219 |
| 5,057,627 A | | 10/1991 | Edwards | 568/618 |
| 5,075,491 A | | 12/1991 | Weaver et al. | 560/45 |
| 5,114,621 A | * | 5/1992 | Guglielmetti et al. | 252/589 X |
| 5,372,864 A | | 12/1994 | Weaver et al. | 428/36.92 |
| 5,384,377 A | | 1/1995 | Weaver et al. | 525/437 |
| 5,442,086 A | | 8/1995 | Krutak et al. | 558/401 |
| 5,886,764 A | * | 3/1999 | Engardio et al. | 264/1.32 X |
| 5,922,246 A | * | 7/1999 | Matsushita et al. | 252/589 X |
| 6,074,579 A | * | 6/2000 | Greshes | 264/1.32 X |
| 6,228,910 B1 | * | 5/2001 | Shakhnovich | 524/88 |
| 6,355,723 B1 | * | 3/2002 | van Baal et al. | 524/602 |
| 6,589,649 B2 | * | 7/2003 | Oya et al. | 428/343 |
| 2003/0212172 A1 | | 11/2003 | Danielson et al. | 524/190 |

FOREIGN PATENT DOCUMENTS

WO WO 01/19921 A1 * 3/2001

OTHER PUBLICATIONS

Bayer Chemicals, Product Information, MACROLEX Violet B Gran, http://www.colorants.bayerchemicals.com/bayer/chemicals/cps.nsf/0/77db0537111e1adbc1256de8003ce0b8?OpenDocument, (Oct. 2003), 2 pages.*

Bayer Chemicals, Product Information, MACROLEX Violet 3R Gran, http://www.colorants.bayerchemicals.com/bayer/chemicals/cps.nsf/0/77db0537111e1adbc1256de8003ce0b8?OpenDocument, (Oct. 2003), 2 pages.*

International Search Report; International Application No. PCT/US03/13222; International Filing Date Apr. 29, 2003; Form PCT/ISA/220 (Apr. 2002).

* cited by examiner

*Primary Examiner*—Daniel S. Metzmaier
(74) *Attorney, Agent, or Firm*—Terry T. Moyer; John E. Vick, Jr.

(57) ABSTRACT

Combinations of at least two individual colorant compounds that provide effective toning (or bluing) to combat yellowing within polyester articles (such as bottles, containers, and the like) are provided. Such a novel toner combination permits effective neutralization of yellowness while also providing highly desirable low haze and increased brightness due to a sharp absorption peak within the needed range of wavelengths (e.g., from about 565 to 590 nm) and a narrow half-height band width. Furthermore, such a combination of compounds is preferably liquid in nature and may thus be incorporated within an added ultraviolet absorber solution or shelf-stable dispersion to facilitate addition within target polyesters at various stages of production. The inventive combination bluing agent accords effective neutralization of UV absorber yellowing as well. Methods of production and liquid UV absorber/individual bluing agent formulations are also encompassed within this invention.

3 Claims, No Drawings

COMBINATIONS FOR USE AS TONERS IN POLYESTERS

FIELD OF THE INVENTION

This invention relates to combinations of individual colorant compounds that provide effective toning (or bluing) to combat yellowing within polyester articles (such as bottles, containers, and the like). Such a novel toner combination permits effective neutralization of yellowness while also providing highly desirable low haze and increased brightness due to a sharp absorption peak within the needed range of wavelengths (e.g., from about 565 to 590 nm) and a narrow half-height band width. Furthermore, such a combination of compounds is preferably liquid in nature and may thus be incorporated within an added ultraviolet absorber solution or shelf-stable dispersion to facilitate addition within target polyesters at various stages of production. The particular UV absorbers desired as additives within target polyesters also tend to exhibit certain yellowing effects that require attention as well. The inventive combination bluing agent thus also accords effective neutralization of such UV absorber yellowing as well. Methods of production and liquid UV absorber/individual bluing agent formulations are also encompassed within this invention.

BACKGROUND OF THE PRIOR ART

It is a recurring well known problem that undesirable yellowing exists within polyester fibers and plastics. Furthermore, with the advent of adding UV absorbers within certain polyester containers and/or bottles as protectants for liquids and foodstuffs kept therein, this yellowing problem is compounded. Since UV absorbers absorb visible light most heavily in the low wavelength violet and indigo range of wavelengths, they produce a resultant yellow appearance within polyester. If such a plastic is clear and/or uncolored, the yellow appearance reduces the aesthetics thereof, particularly within thicker plastic portions (such as the bottom or bottlecap support within the neck of a polyester bottle), thus reducing the desirability of such an article from widespread commercial use.

The yellowing of the polyester by itself has been effectively reduced in the past, at least from a straightforward neutralization standpoint, through the utilization of certain types of toners that are incorporated into the target polyester in order to mask, hide, or neutralize the yellow color within the visible spectrum. Such toners for polyester must not exhibit extraction, must not be susceptible to degradation due to exposure to light, humidity, temperature, and other such drastic conditions. Such bluing agents should also exhibit a minimal degree of thermal degradation (or, conversely, excellent thermal stability) during polyester manufacture, desirably at any stage during plastic production, but acceptably at any stage of the article manufacturing process. In addition, the toner must have minimal adverse effects on the physical properties of the polyester polymer, such as in terms of reducing the intrinsic viscosity thereof.

One of the most prevalent compounds for this purpose is cobalt acetate. However, such a compound exhibits disadvantageous characteristics that limit its desirability for such an application. For example, cobalt acetate toned materials tend to be unstable during storage and are particularly susceptible to temperature and humidity, and tends to undergo an undesirable color shift toward yellow. Further, when high cobalt concentrations are needed to mask the yellow color of some polymers there is a tendency to impart a gray hue to the polymer. This grayness is believed, without intending on being bound to any specific scientific theory, to result from the broad range of wavelength over which this compound absorbs at a relatively high level. This effect appears to be attributable to the extremely broad half-height bandwidth thereof. As a result, and with such a relatively high absorption level over such a wide range of wavelengths, the brightness of the target polyester is compromised and the appearance thereof is dulled. Such a compound is also limited in its additive levels within polyesters by governmental mandates due to suspect effects of cobalt in relatively high amounts within such end-use articles, among other problems.

Additional toners include costly and rather suspect types within U.S. Pat. No. 4,745,174. Disclosed therein are certain 1-cyano-3H-dibenz-isoquinoline-2,7-diones that are effective as bluing agents generally; however, they are also expensive to manufacture and exhibit potential environmental and toxicological issues relative to their manufacture and use.

U.S. Pat. Nos. 5,384,377 and 5,372,864 both disclose mixed compound toner systems requiring red anthraquinones and blue anthraquinones. Such mixtures are polymerized into the target polyester (thereby exhibiting no migration within or therefrom) and provide a certain degree of effective neutralization of yellowing. However, as noted in greater detail below, such mixtures of compounds also generate a dullness or grayness within the target polyester that is undesirable to a certain aesthetic level. As with the cobalt acetate above, the combination of red and blue color synergistically produce a broad absorption spectrum with a rather wide half-height bandwidth. The resultant absorption peaks exhibited by such a combination are favorable to yellow neutralization, however, the high absorption levels exhibited for wavelengths not complementary to the generated yellow within the target polyester also dulls the resultant plastic. Furthermore, this combination is primarily utilized through polymerization within the target resin at the polyester polymerization stage. Although such compounds may be introduced at later stages of polyester production, these compounds are not disclosed as liquids, only as solid colorants. Thus, in addition to the prior art discussed above, nothing has been disclosed providing liquid solutions or dispersions of such combinations with UV absorbers to provide an easy-to-incorporate and/or -handle formulation of such type for the polyester manufacturer. To date, nothing has been taught nor fairly suggested providing a combination of compounds for bluing purposes within polyesters that provides effective yellowness neutralization as a heavy metal-free additive, and exhibits a narrow half-height bandwidth in order to provide a finished clear polyester with very high brightness and hue angle levels.

OBJECTS OF THE INVENTION

Therefore, an object of the invention is to provide a combination of colorants as a bluing agent for polyester fibers and articles that exhibits very low extraction therefrom, excellent anti-yellowing results therein (within the plastic alone or in combination with a yellowing additive, such as an UV absorber compound), and high brightness (c value) levels and whiteness (L value) levels (in accordance with CIELab standards). Another object of the invention is to provide a bluing agent combination of compounds exhibiting $\lambda_{max}$ measurements between 565 and 590 nm wavelengths and half-height bandwidths within a narrow range of at most about 135 nm. Additionally, it is an object of this invention to provide a liquid dispersion or solution bluing agent/UV absorber formulation for introduction within polyester resins for UV protection and anti-yellowing properties.

DETAILED DESCRIPTION OF THE INVENTION

Accordingly, the present invention encompasses a polyester fiber or article comprising at least two different compounds that, in combination, provide bluing effects within said fiber or article, and optionally at least one ultraviolet absorbing compound; wherein said combination of compounds exhibits at least one absorption peak and a $\lambda_{max}$ between 565 and 590 nm within said polyester fiber or article; and wherein said bluing agent combination exhibits a half-height bandwidth of at most 135 nm in relation to said at least one absorption peak; and, optionally, wherein said combination comprises a first compound exhibiting a single absorption peak and a $\lambda_{max}$ between 555 and 575 nm and a second compound exhibiting a single absorption peak and a $\lambda_{max}$ between 576 and 605 nm. The present invention further encompasses a method for providing anti-yellowing benefits to a polyester fiber or article wherein said fiber or article optionally comprises at least one ultraviolet absorber compound, said method comprising providing a molten polyester formulation, introducing a bluing agent combination of compounds to said molten polyester wherein said bluing agent exhibits at least one absorption peak and a $\lambda_{max}$ between 565 and 590 nm within said polyester fiber or article; and wherein said bluing agent exhibits a half-height bandwidth of at most 135 nm in relation to said at least one absorption peak, and allowing the resultant polyester/bluing agent formulation to cool into a predetermined shape or form. Furthermore, this invention encompasses a liquid solution or dispersion comprising at least one ultraviolet absorber compound and at least one two compounds in combination forming a bluing agent, wherein said bluing agent exhibits at least one absorption peak and a $\lambda_{max}$ between 565 and 590 nm within said polyester fiber or article; and wherein said bluing agent exhibits a half-height bandwidth of at most 135 nm in relation to said at least one absorption peak.

For the purposes of this invention, the term "bluing agent" is synonymous with "toner for polyester". Such a term thus encompasses a combination of compounds that combats and neutralizes the yellowing of either polyester alone or a yellowing polyester comprising any further additives, including any yellowing additives (such as UV absorbers, as one example). Generally, yellow colorations within polyester, intended to be colorless and thus clear and transparent within the visible spectrum, create aesthetic problems within target resins. Such yellow colorations absorb within the visible and ultraviolet spectrum at about 390–450 nm. As noted above, neutralization of such unwanted color is thus necessary within the visible spectrum to provide a pleasing appearance, particularly in thicker portions of target polyester articles and/or fibers. The inventive selection of a combination toner for this purpose has been found, unexpectedly, to be possible upon determination of a specific combination interacting to provide a bluing agent that absorbs within the needed wavelength range (565 nm to 590 nm; more preferably from 565 to 580 nm; most preferably from about 570–575 nm). In addition, it was determined that such a variable as absorption was not the only necessary property to provide the best overall bluing characteristics to combat undesirable yellowing problems. Thus, a single peak or narrow multiple peaks facilitated addition and control of the needed final neutralization result. In addition, such a single peak required a very narrow half-height bandwidth for a number of reasons. Most importantly, such a narrow range permits a brighter result in the target resin, as well as a reduction in grayness therein. Prior art bluing agents tend to provide excellent neutralization of yellowness within target polyesters; however, the half-height bandwidth of such additives are so broad that absorption values are extensive over a broader range of wavelengths to the extent that such toners not only effectively neutralize the yellowness, but also dull the finished plastic article as well. Thus, the inventive toner has remedied all of these prior problems and unexpectedly accorded the industry with a combination of compounds that overcomes such dulling and graying in order to provide a highly desirable, aesthetically pleasing clear polyester fiber and/or article. It is important to note that the graying ability of prior art bluing agents contributed significantly to their overall abilities to combat yellowness and thus such broad half-height bandwidth properties were normally considered necessary to such an end result. Unexpectedly, it has now been determined that a narrower characteristic can actually function properly as a suitable bluing agent while also reducing dullness in a finished polyester, particularly clear polyester, article. However, it is foreseen that too narrow a half-height bandwidth would produce unwanted different colors (such as, for example, green colorations) within the finished article due to a potential lack of proper complementary absorption capabilities from a broad enough perspective to combat yellowness completely. The specific limit on narrowness in such a situation is not known, however, although, again, it is foreseen that a limit to the effectiveness upon too narrow a measurement does exist.

Other important benefits from such an inventive multi-component polyester toner include low haze results within clear articles, sufficiently high absorption levels for highly effective yellow neutralization at relatively low toner loading levels, and proper hue angle readings. Haze is a very important property of polyester articles, particularly for food stuff and liquid containers, as the consumer expects and generally requires the ability to view the contained matter therein when stored. For that matter, such contained liquid and/or foodstuffs also generally require the presence of UV absorbers within the polyester as well in order to prevent degradation thereof due to UV exposure. Such UV absorbers, as noted above, can discolor (yellow) the resin thereby necessitating the presence of such bluing agents for evident reasons. Thus, with the presence of additives for these purposes, the potential for transparency reduction in the article increases. Such a requirement is not limited to finished containers, but also pre-form (pre-blown) articles as well. Thicker pre-form articles must exhibit minimal haze in order to ensure proper re-heating and blowing to consequently form the finished article, not to mention effective transparency within the finished article as well. The inventive combination toner, to the contrary, does not deleteriously effect such a property. Such a combination also can be added in very low amounts, from about 0.001 to about 100 ppm (with from about 0.0005 to about 50 ppm of each individual component within the inventive combination permitted; preferably from about 0.001 to about 40 ppm each; more preferably from about 0.01 to about 30 ppm each; and most preferably from about 0.1 to about 15 ppm) of the total parts of polyester (such as polyethylene terephthalate as one highly preferred, non-limiting example; others include PEN, polybutylene terephthalate, polytrimethylene terephthalate, polylactic acid, and the like). The level of loadings depends highly upon the strength of the colorant needed to provide the desired anti-yellowing effect while also not contributing an excess in blue or violet discoloration to the target resin. Furthermore, the end-use itself may justify higher loadings (such as as high as 100 ppm) if the thickness of the target article is sufficiently low such that the amount of yellowing additives is high throughout and discoloration by bluing agents is unlikely at higher loading levels. Even at such low preferred loadings, the high absorption levels within the needed range of wavelengths, as noted above, provide sufficient yellowness neutralization heretofore unseen for multi-compound toners. The hue angle results contribute to the overall brightness of the resin as well, thereby according a highly desirable end product.

The class of compounds that exhibit such effective and beneficial combined characteristics include those within the noted range of narrow wavelengths above. Thus, a violet or bluish-violet colorant of between about 555 to 575 nm lambda max in combination with a reddish or reddish-violet colorant of between about 576 to 605 nm is preferred for such purpose. Such a combination thus preferably comprises, though not necessarily, non-heavy metal containing dyes, such as solvent dyes. Highly preferred, though again, a non-limiting combination, is a mixture of Solvent Violet 36 (available from Bayer under the tradename Macrolex Violet 3R Granulate) and Solvent Violet 13 (available from Bayer under the tradename Macrolex Violet B Granulate). Such a combination of colorants interacts within the target resin to exhibit a lambda max of about 572 to 573 nm, with a maximum absorption of about 1.5, a half-height bandwidth of about 117, a brightness (c value) of about 31, a grayness (L value; a low L value indicates a grayer result whereas a higher L value indicates improved whiteness) of about 63, and a hue angle (h value) of about 293 (all under the CIELab standard measurements). Such a combination also does not appreciably affect the haze of the polyester resin and effectively combats yellowness of both the resin itself and the presence of UV absorbers as well. Furthermore, being a solid, but dispersible dyes, such a toner combination also can be added easily to any stage of the plastic manufacturing process, and can be stored conveniently within a dispersion with the desired UV absorber for simultaneous and effective introduction within such a manufacturing procedure. Additionally, such a novel combination exhibits very little, if any, extraction from the target resin. As such, this combination bluing agent meets all of the necessary requirements noted above.

The UV absorbers possible within this invention, either for separate addition to the target polyester resin or for solution or dispersion formulation for simultaneous introduction within the manufacturing process itself for resin production, include any well known types for such polyesters. Thus, Ciba Specialty Chemicals additives, such as benzotriazole types (under the tradename TINUVIN® or SHELFPLUS®) or those offered by Milliken & Company under the tradename CLEARSHIELD®, and disclosed within U.S. patent application Ser. No. 09/934,377, for example, may be present for such a purpose within the target polyester fiber and/or article. Such UV absorbers are highly effective in preventing UV exposure to the resin itself or to any stored materials within such polyester articles. Again, though, such additives inherently exhibit yellowing problems without non-colored resins and thus require the presence of bluing agents to provide not only a highly effective UV block, but also an aesthetically pleasing article.

The term polyester thermoplastic material (or composition or resin) is intended to encompass any polyester, including co-polymers of different polyesters, thermoplastics comprised of a majority of polyester constituents, and a single polymer of polyester (i.e., polyethylene terephthalate, which is the preferred species). Feedstock is intended to encompass virgin or recycled polyester, whether in shredded, chipped, pelletized, or any like form. The term thermoplastic is well known in the art to mean a polymeric material which will melt upon exposure to sufficient heat but will retain its solidified state, but not prior shape without use of a mold, upon sufficient cooling. The inventive colored polyester thermoplastic is intended to be utilized ultimately as, for instance and not by limitation, containers for soft drinks, beer, liquor, water, and the like, as well as containers for any solid materials.

Further criteria which the particular inventive combination toner exhibits includes thermal stability while undergo high melting temperatures during the extrusion process; no degradation of the polyester either during processing or once the final product is made; cost effectiveness so as not to translate into higher prices for the consumer; transparency of the polyester is uniform throughout the entire finished product; low viscosity in order to permit better processing conditions; homogeneity of dissolution of the toner within the polyester; and substantially no migration of the toner from and within the finished polyester thermoplastic product. The inventive compound exhibits all of these necessary characteristics which thus shows the care and degree and analysis required in order to select the proper toner for introduction within the proper polyester resin.

The UV protected resin comprises about 0.01 to about 1% by weight of UV absorber within the target polyester. Preferably the amount of UV absorber is from about 0.05 to about 0.5% and most preferably from about 0.1 to about 0.3%. Optional additives may include plasticizers, such as PEG-400 and dibutyl phthalate, and the like, antistatic agents, stabilizers, and other similar standard polyester thermoplastic additives (such as acetaldehyde scavengers, as one example).

The inventive liquid solution or dispersion of bluing agent plus UV absorber may include a ratio by parts of the two components (with any needed solvents, viscosity modifiers, and the like, also permitted) anywhere from 0.001:100 to about 1:10. Preferably, such a range of ratios is from 0.01:100 to about 1:20, more preferably from about 0.05:100 to about 1:100, and most preferably from about 0.1:100 to about 1:150.

The method of producing the preferred clear non-yellowing resin may include any standard procedure, with the proviso that the added bluing agent should be able to withstand the high temperatures without subliming or degrading (due to a lack of complete thermal stability) at the point of introduction within the desired procedure. Thus, preferred, in order to best ensure proper addition and no thermal stability issues arise, is the introduction of the toner during the injection molding step for the target polyester article.

PREFERRED EMBODIMENTS OF THE INVENTION

Examples of particularly preferred resins are below, with comparisons to the best prior art types offered within the polyester market today.

Inventive Toner

EXAMPLE 1

About 4.5 parts of Solvent Violet 36 were admixed with about 5.5 parts of Solvent Violet 13, resulting in a mix of pigment powders with violet colorations.

EXAMPLE 2

The formulation of EXAMPLE 1 (about 4.5 parts of Solvent Dye 36 and about 5.5 parts of Solvent Dye 13) (about 10 parts total of both components) was then admixed with 2000 parts of CLEARSHIELD® 400, a commercially available UV absorber solution from Milliken & Company. The resultant liquid appeared to be a stable homogeneous solution (the colorants dissolved completely within the UV absorber formulations and exhibited no precipitation over time as well as upon centrifuging the sample), exhibiting a bluish violet color.

EXAMPLE 3

10.3 parts of the colorant from EXAMPLE 1 (about 5.3 parts of Solvent Dye 36 and about 5.0 parts of Solvent Dye 13) were then admixed with 2000 parts of CLEARSHIELD® 400, a commercially available UV absorber solution from Milliken & Company. The resultant liquid appeared to be a stable homogeneous solution exhibiting a bluish violet color.

EXAMPLE 4

3.7 parts of the colorant from EXAMPLE 1 (about 1.9 parts of Solvent Dye 36 and about 1.8 parts of Solvent Dye 13) were then admixed with 2500 parts of TINUVIN® 327, a commercially available UV absorber solution from Ciba Specialty Chemicals. The resultant formulation was a violet powder that was then melt-blended into a polyester resin (as noted below) for ultimate introduction to a finished article during the injection molding step therefor.

Comparative Toners

COMPARATIVE EXAMPLE 1

In accordance with the preferred examples in U.S. Pat. No. 5,384,377, two different dyestuffs were produced for use as a combination of compounds for toning purposes. A blue dyestuff such as that disclosed in (examples 1 and 66) was first prepared. Example 1 of the patent disclosed the reaction of 1,4-bis-(2-ethyl-6-methylanilino)anthraquinone with chlorosulfonic acid to produce the disulfonyl chloride. This disulfonyl chloride was further reacted with ethanolamine to form the disulfamide. Example 66 disclosed the production of 1,4-bis-(2,6-dimethylanilino)-anthraquinone disulfonyl chloride and reacting that with secondary amine. 1,4-bis-(2,6-dimethylanilino)anthraquinone was made in accordance with the procedure of Carroll (Org. Prep. Proceed. Int. 19, 1, 1987, p 57). The blue dyestuff was chlorosulfonated and reacted with ethanolamine according to the procedure in example 1 of the patent. This type of blue colorant was especially difficult to manufacture due to the expense and toxicity of the reagents required as well as the high temperatures and low yields encountered in its synthesis.

COMPARATIVE EXAMPLE 2

The red dyestuff disclosed in the same patent (examples 93, 96, 103, 104, and 118–122) are all free acids or aliphatic esters of 1,5-bis-(o-carboxyanilino)anthraquinone. When added to PET in the melt phase, it is well known that transesterification occured rendering all of these colorants essentially equivalent in coloration. 1,5-bis-(o-carboxyanilino)anthraquinone was made according to U.S. Pat. No. 4,359,570. This dyestuff was transesterified with PEG-400 before incorporation into the target PET.

Other comparative examples included, in accordance with TABLE 2, below

TABLE 2

| Comp. Ex. # | Bluing Agent (ppm if UV Abs. present) | UV Absorber (ppm) |
|---|---|---|
| 3 | Cobalt Acetate | — |
| 4 | Pigment Blue 15[1] | — |
| 5 | Pigment Violet 29[2] | — |
| 6 | Pigment Violet 16 | — |
| 7 | Comp. Ex. 5 (75) admixed with Comp. Ex. 4 (187) | ClearShield 400 (2000) |
| 8 | Comp. Ex. 5 (3.6) admixed with Comp. Ex. 4 (21.7) | ClearShield 400 (2000) |
| 9 | Comp. Ex. 5 (43) admixed with Comp. Ex. 4 (235) | ClearShield 400 (2000) |

[1]Available from Holliday Chemicals under the tradename Ultramarine Violet Premier FVU
[2]Available from Holliday Chemicals under the tradename Premier DFRX
[3]Available from Holliday under the tradename 6139 Violet Premier VM Manganese Thermoplastic Part Formation The plastic additive was introduced within an injection molding operation for a polyester thermoplastic, for instance polyethylene terephthalate. The plastic additive was blended via agitation onto hot, dried polyethylene terephthalate resin (available from M&G Polymers under the tradename ClearTuf® 8006)(in pellet form). The blend of additives and pellets was gravity fed into the feed throat of the machine. In the feed section, melting was accomplished through the utilization of a heated (heat transferred from the barrel of the machine) screw extruder which rotated. The rotation of the screw provided thorough mixing of the colorant and molten resin together producing a uniform plastic melt which was injected into a mold in order to form the thermoplastic article, for instance a 2 inch by 3 inch plaque with a uniform thickness of 50 mils.

Spectral Performance Evaluation

The bluing agents were evaluated at a loading that would provide a maximum absorbance of the colored component between 0.01 and 2.0 A (i.e., in sufficient amounts to permit initial spectral evaluation in order to determine which toners met the required characteristics of, at least, $\lambda_{max}$ measurements, as one example). The spectral performance was performed by adding the additive into polyester in the method described above. The absorbance characteristics were measured on a Perkin-Elmer Lambda 35 UV-Vis Spectrometer with a 50 mm Integrating Sphere. The maximum absorbance and the wavelength at maximum absorbance were measured using the Perkin-Elmer WinLab software. The half-height bandwidth was calculated by manually determining the width of the absorbance curve at the midsection of the height of the maximum absorbance. The spectral performance of the inventive and comparative examples are shown in Table 3 (Max. Abs. Indicates the maximum absorption of the bluing agent and HHBW is the half-height bandwidth)(the last comparative example below is in accordance with the preferred bluing agent of U.S. Pat. No. 5,384,377, and Comparative Example 1 of this combination exhibits two lambda max absorption peaks):

TABLE 3

| Bluing Agent (nm) | Loading (ppm) | $\lambda_{max}$ (nm) | Max. Abs. | HHBW |
|---|---|---|---|---|
| Example 1 (Comparatives) | 154.4/145.6 | 572.3 | 1.487 | 116.7 |
| Solvent Violet 36 | 300 | 564.7 | 1.449 | 116.7 |
| Solvent Violet 13 | 300 | 592.9 | 1.558 | 116.7 |

TABLE 3-continued

| Bluing Agent (nm) | Loading (ppm) | $\lambda_{max}$ (nm) | Max. Abs. | HHBW |
|---|---|---|---|---|
| Comp. Example 4 | 300 | 517.9 | 0.069 | 125.0 |
| Comp. Example 5 | 300 | 594.96 | 0.015 | 120.8 |
| Comp. Example 3 | 2000 | 569.27 | 0.160 | 122.9 |
| Comp. Example 1 | 300 | 622.2/579.9 | 0.851/0.824 | 108.3 |
| Comp. Example 2 | 1500 | 512.9 | 2.15 | 95.8 |
| Combination of Comp. Exs. 1 and 2 | 1(529); 2(1046.5) | 533/573.1/ 622.2 | 1.74/1.63/ 1.41 | 168.5 |

As initial indications, it is evident that the inventive bluing agent combinations provide the needed lambda max measurement to best combat yellowing as needed within polyester. Neither of the Holliday pigments provided this required absorption wavelength. The HHBW of each of these pigments and cobalt acetate are excessive, particularly for the amount of cobalt acetate needed to accord a high enough absorption level for proper functioning. The comparative agent combination exhibiting three substantial peaks, with the lower wavelength, well outside the range needed for anti-yellowing, exhibited the highest level of such undesirable properties. The HHBW thereof was accordingly extremely broad. These agents were then tested for colorimetric purposes within the target polyesters at these higher levels were then made as an initial screen for proper end results.

The colorimetric data of the bluing agents in the 50 mil polyester parts was measured using a Gretag-Macbeth ColorEye 7000A Spectrophotometer. The reflective calorimetric data, specifically L*, indicating the lightness/darkness, c*, indicating chroma, and the h°, indicating hue angle, are shown in Table 4:

TABLE 4

| Bluing Agent | Loading | L* | c* | $h^0$ |
|---|---|---|---|---|
| Example 1 (Comparative) | 154.4/145.6 | 31.0 | 63.1 | 293.0 |
| Combination of Comp. Exs. 1 and 2 | 1(529); 2(1046.5) | 27.8 | 17.9 | 294.6 |

These vastly different measurements for each sample thus indicates the possibility that the inventive combination will provide better brightness, and grayness properties, at least, to the target polyester upon utilization at bluing agent levels. Highly desired are higher L* and c* values, which indicate brighter appearances within finished polyester articles.

Bluing Agent Performance Evaluation

The performance of the bluing agents was evaluated by adding an ultraviolet light-absorbing compound and a bluing agent to the polyester pellets and injection molding a 2 inch by 3 inch plaque with a uniform thickness of 175 mils. The calorimetric data, Yellowness Index, and haze were measured on the 175 mil plaques. The Yellowness Index, as defined in ASTM E313, is a measure of how far an object departs from a preferred white towards yellow. The colorimetric data and Yellowness Index was measured using a Gretag-Macbeth ColorEye 7000A Spectrophotometer. The haze was measured using a BYK Gardner Haze-Gard Plus Hazemeter. The bluing agent performance is shown in Table 5:

TABLE 5

| UV Abs. + Bluing Agent (ppm) | Yellowness Index | Haze | L* | a* | b* |
|---|---|---|---|---|---|
| None | 1.5 | 8.7 | 92.2 | −0.22 | 1.23 |
| ClearShield 400 (2000) alone | 17.8 | 13.1 | 90.6 | −2.46 | 13.9 |
| Example 3 | −1.77 | 15.1 | 79.4 | −0.71 | 0.44 |
| Comp. Example 7 | −0.48 | 38.2 | 81.4 | −2.01 | 0.64 |
| Comp. Example 8 | 16.4 | 18.6 | 90.1 | −2.24 | 12.7 |
| Comp. Example 9 | 1.9 | 45.7 | 82.9 | −0.31 | 2.13 |
| Example 4 | −0.55 | 9.6 | 88.0 | −0.76 | −0.13 |

Thus, it is evident that the inventive combination bluing agent provides the most effective bluing characteristics for polyester resins as well as meeting all other requirements for broad utilization within such articles, most notably at very low loadings such an inventive bluing agent combination provides low haze, effective anti-yellowing, and high brightness characteristics, at least, and all in excess of the comparative types.

Having described the invention in detail it is obvious that one skilled in the art will be able to make variations and modifications thereto without departing from the scope of the present invention. Accordingly, the scope of the present invention should be determined only by the claims appended hereto.

Which is claimed is:

1. A polyester fiber or article comprising at least two different compounds that, in combination, provide bluing effects within said fiber or article, and optionally at least one ultraviolet absorbing compound; wherein said combination comprises a first compound exhibiting a single absorption peak and a $\lambda_{max}$ between 555 and 575 nm and a second compound exhibiting a single absorption peak and a $\lambda_{max}$ between 576 and 605 nm; wherein the total parts by weight of the first compound and second compound is in the range of about 0.001 to about 100 ppm of the total parts of polyester.

2. A method for providing anti-yellowing benefits to a polyester fiber or article wherein said fiber or article optionally comprises at least one ultraviolet absorber compound, said method comprising providing a molten polyester formulation, introducing a bluing agent combination of compounds to said molten polyester wherein said combination comprises a first compound exhibiting a single absorption peak and a $\lambda_{max}$ between 555 and 575 nm and a second compound exhibiting a single absorption peak and a $\lambda_{max}$ between 576 and 605 nm; and wherein said bluing agent combination makes up about 0.001 to about 100 ppm of the total parts of polyester.

3. A liquid solution or dispersion comprising at least one ultraviolet absorber compound and at least two compounds in combination forming a bluing agent, wherein said bluing agent exhibits at least one absorption peak and a $\lambda_{max}$ between 565 and 590 nm within said polyester fiber or article; wherein said combination comprises a first compound exhibiting a single absorption peak and a $\lambda_{max}$ between 555 and 575 nm and a second compound exhibiting a single absorption peak and a $\lambda_{max}$ between 576 and 605 nm; and wherein said bluing agent combination makes up about 0.001 to about 100 ppm of the total parts of polyester.

* * * * *